US005271448A

United States Patent [19]

Delgado

[11] Patent Number: 5,271,448

[45] Date of Patent: Dec. 21, 1993

[54] MOVABLE BARRIER WITH TWO PART GUIDE FOLLOWER

[75] Inventor: Joe M. Delgado, Hartford, Wis.

[73] Assignee: Rytec Corporation, Jackson, Wis.

[21] Appl. No.: 919,887

[22] Filed: Jul. 27, 1992

[51] Int. Cl.[5] ..... E06B 9/17

[52] U.S. Cl. ..... 160/265; 160/271

[58] Field of Search ..... 160/265, 266, 267.1, 160/268.1, 269, 270, 271, 272, 273.1, 274, 275, 276, 277, 278, 279, 280, 281, 282, 283, 284, 285, 286, 287, 288, 289, 133, 23.1

[56] References Cited

U.S. PATENT DOCUMENTS 3,878,879 4/1975 Manns .
3,981,343 9/1976 DeVito ..... 160/133 X
4,141,044 8/1992 Hying et al. .
4,478,268 10/1984 Palmer ..... 160/172 X
4,676,293 6/1987 Hanssen .
5,025,847 6/1991 Mueller .
5,048,588 9/1991 Weishar et al. .
5,056,579 10/1991 Krafutler .
5,139,074 8/1992 Warner ..... 160/265 X
5,139,075 8/1992 Desrochers ..... 160/265 X
5,141,043 8/1992 Kraeutler ..... 160/267.1 X

*Primary Examiner*—David M. Purol
*Attorney, Agent, or Firm*—Willian Brinks Hofer Gilson & Lione

[57] ABSTRACT

An overhead roll door includes a breakaway guide follower having a first part attached to a raising and lowering mechanism and a second part attached to the door. The first part defines a pivotable latch plate having a slot therein, and the second part of the guide follower defines a pin received in the slot. A detent mechanism resists rotation of the latch plate out of a retaining position, in which the first and second retaining elements are held together, to a release position, in which the second retaining element is allowed to move transversely with respect to the first retaining element to allow the door to breakaway in response to an impact.

22 Claims, 4 Drawing Sheets

MOVABLE BARRIER WITH TWO PART GUIDE FOLLOWER

BACKGROUND OF THE INVENTION

This invention relates to a movable barrier such as a roll door having a two part guide follower that separates in response to a force in excess of a predetermined magnitude.

U.S. Pat. No. 5,025,847, assigned to the assignee of the present invention, discloses a roll door having a two part guide follower. This guide follower is designed to separate to allow the door and one part of the guide follower to be released from the other part of the guide follower in response to an excessive transverse force.

The system described in the above-identified patent has found widespread use, and has been found to significantly reduce the damage to overhead doors caused by unintended impacts, as for example with a moving fork-lift. In the event of such an impact, the guide follower separates, and the door is allowed to move transversely of the opening without damage to the door or to the guide followers. After the impact, the two part guide follower can readily be reassembled without extensive disassembly of the door mechanism and without special tools.

This represents a great improvement over the prior art approach in which the door was rigidly fastened to the guide follower. With this prior art approach the door could easily be damaged in the event of an impact, and such damage might require disassembly of the door or its mechanism and the replacement of bent or otherwise damaged parts. Of course in the event such parts were not kept on hand, such a repair could leave the door in an inoperable condition for an extended time.

The present invention is directed to further improvements in the basic system described in the above-identified patent, in order to make the two-part guide follower operate more consistently and more reliably, and to allow it to be reassembled more easily.

SUMMARY OF THE INVENTION

Accordingly, it is an object of this invention to provide a two-part guide follower for a movable barrier of the type described above that protrudes to only a small degree into the opening and is therefore less easily damaged, that operates repeatedly and precisely to hold the door in position until transverse forces exceed a preset threshold force, that allows ready adjustment of the threshold force required to release the follower, and that facilitates reassembly of the two-part guide follower after separation.

This invention is embodied in the apparatus described in detail below in connection with the drawings. The apparatus shown in the drawings includes a guide positioned alongside an opening such as a doorway and a movable barrier such as a roll door configured to selectively block the opening. A guide follower is attached to the barrier and is coupled to the guide to control movement of the barrier. This guide follower includes first and second parts, one attached to the barrier and the other positioned adjacent to the guide. The first part of the guide follower includes a mounting element and a first retainer element pivotably mounted to the mounting element. This first retainer element is pivotable between a retaining position and a release position. The second part of the guide follower includes a second retainer element configured and positioned (1) to engage the first retainer element when the first retainer element is in the retaining position to hold the first and second parts together, and (2) to disengage from the first retainer element when the first retainer element is in the release position to allow the first and second parts to separate from one another. Means are provided for releasably holding the first retainer element in the retaining position against forces in a first, lower range values tending to move the barrier transverse to the guide, while allowing the first retainer element to move from the retaining to the release position in response to forces in a second, higher range of values tending to move the barrier transverse to the guide, thereby allowing the first and second parts to separate from one another in response to forces in the second range of values.

DETAILED DESCRIPTION OF THE PRESENTLY PREFERRED EMBODIMENTS

Figure 1:
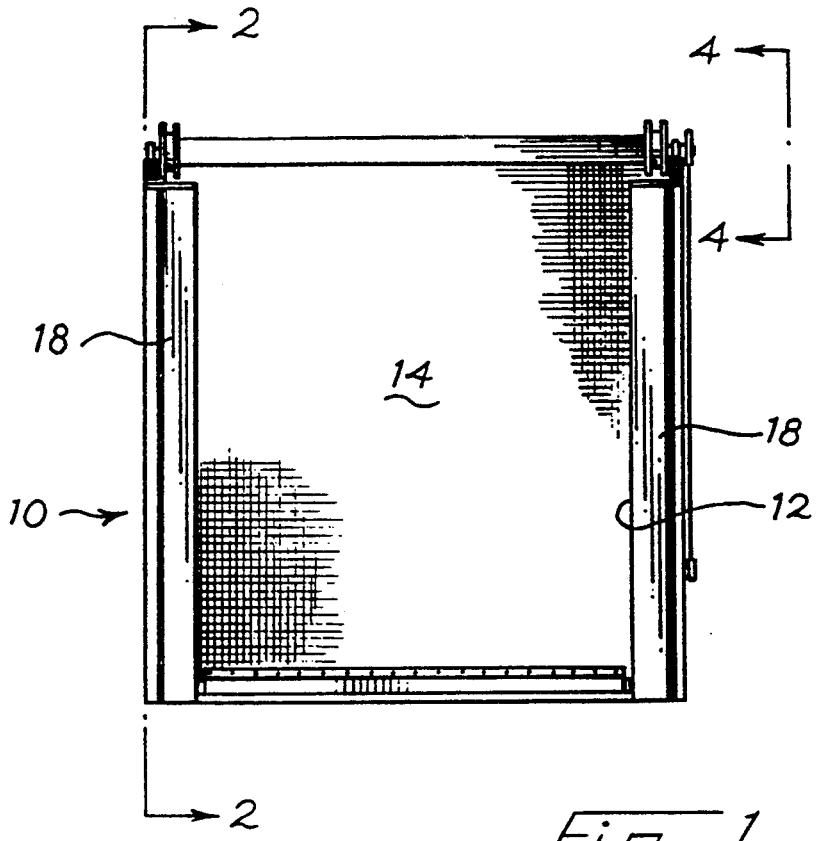
FIG. 1 is a plan view of a roll door which incorporates a presently preferred embodiment of this invention.
Figure 4:
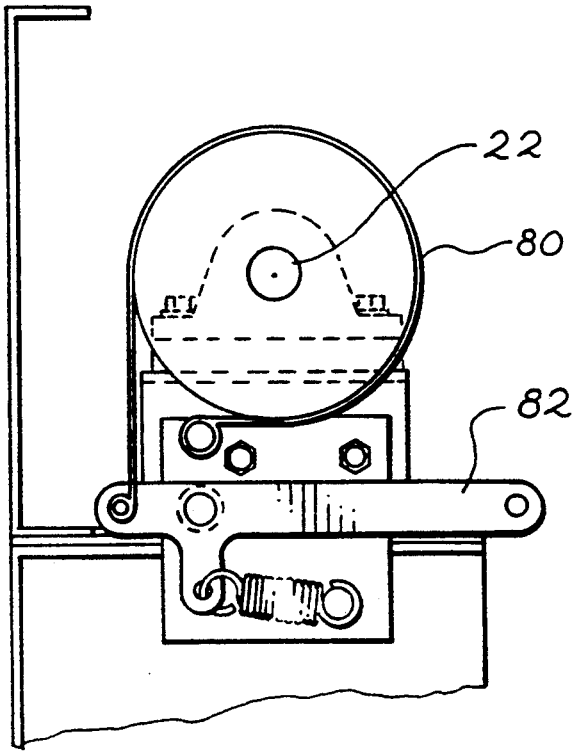
FIG. 4 is a cross-sectional view taken along line 4—4 of FIG. 1.

Turning now to the drawings, FIG. 1 shows an elevational view of a doorway 10 which defines an opening 12. This opening 12 can be selectively closed by a door 14 which in this embodiment is a roll door made of a flexible sheet. Two guides 16 are provided in spaced, parallel relationship, one on either side of the opening 12. Each guide 16 is covered by a hinged door panel 18, which can be opened to provide access to the elements shown in FIG. 3.

Figure 3:
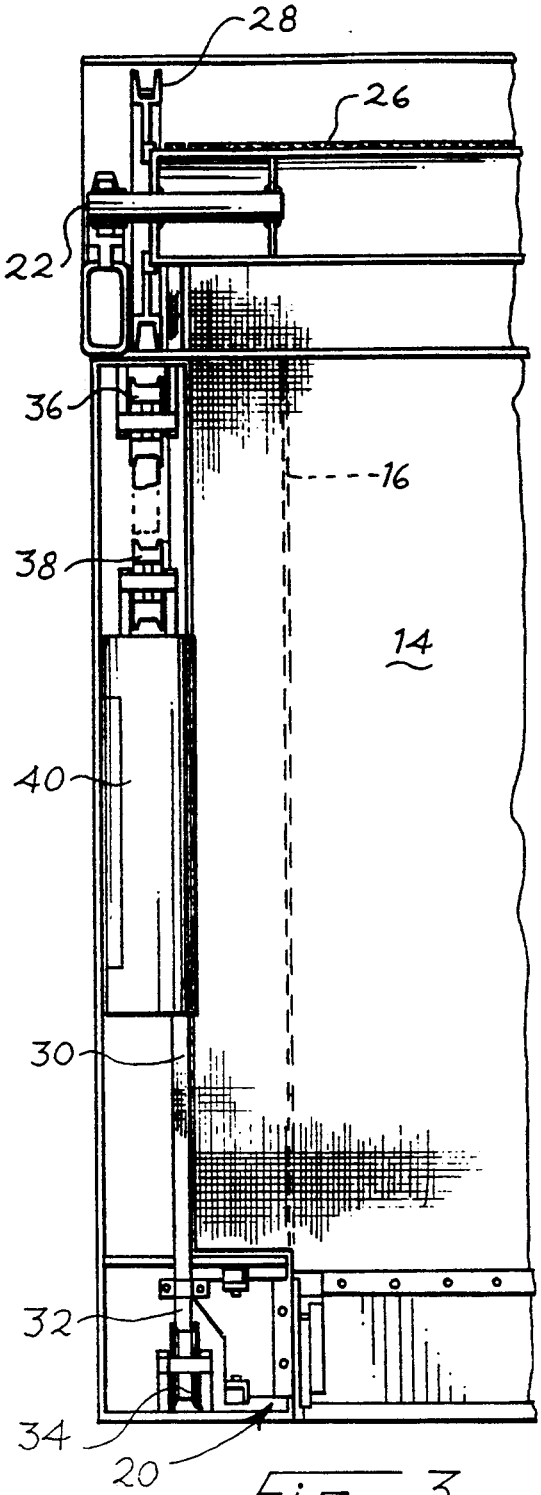
FIG. 3 is a cross-sectional view taken along line 3—3 of FIG. 2.

As shown in FIG. 3, a guide follower 20 is secured adjacent to each of the guides 16 at a respective lower corner of the door 14. The guide followers 20 cooperate with the guides 16 to guide the door 14 in vertical motion between a lowered position in which the door 14 covers the opening 12, and a raised position which the door 14 is moved above the opening 12.

Situated above the opening 12 is a rotatable shaft 22. The shaft 22 has mounted to it a roller 26 and a reel 28, such that the roller 26 and the reel 28 are rotated in unison by the shaft 22. The roller 26 receives the door 14 such that rotation of the roller 26 in a first direction raises the door 14, and rotation of the roller 26 in the reverse direction allows the door 14 to be lowered.

Figure 5:
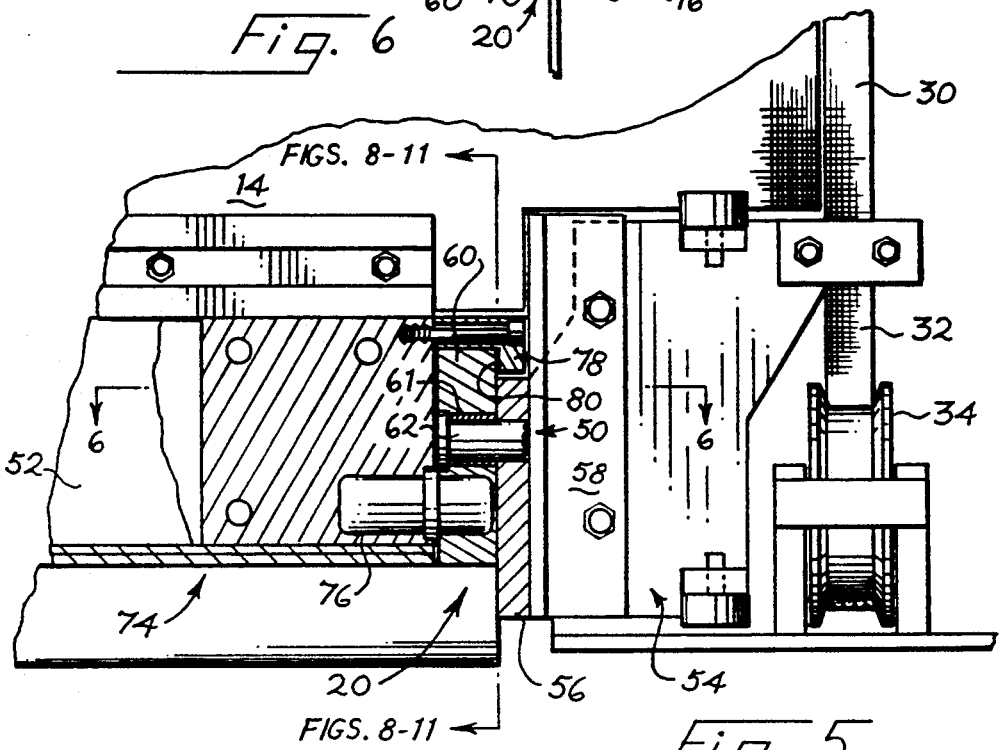
FIG. 5 is an enlarged view in partial section of a breakaway mechanism included in the door of FIGS. 1–4.
Figure 7:
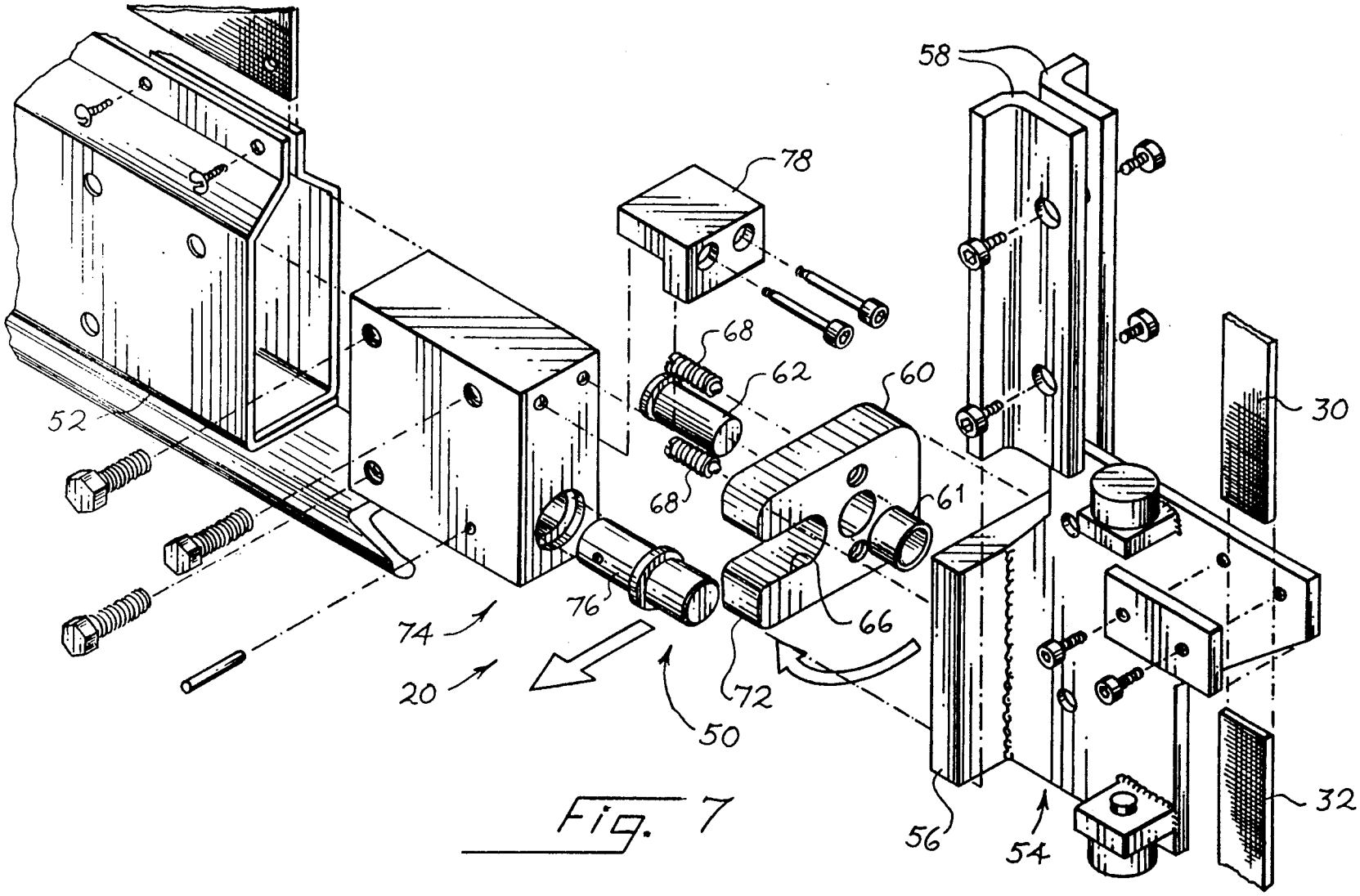
FIG. 7 is an exploded perspective view of the elements of FIG. 5.

As shown in FIGS. 3, 5 and 7, a raising strap 30 and a tensioning strap 32 are mounted to each of the guide followers 20. The raising strap 30 is positioned closely adjacent to an edge of the door 14 and is wound about the same roller 26 as the door 14. Preferably, the raising strap 30 is formed of the same material as the door 14, and the raising strap 30 can be made of a strip of fabric cut from the adjacent edge of the door 14. Because the raising strap 30 is formed of the same material as the door 14 and is wound on the same roller 26, the lower end of the raising strap 30 attached to the guide follower 20 moves in unison with the lower edge of the door 14 as a motor (not show) rotates the shaft 22.

The tensioning strap 32 is also secured to the guide follower 20. From the guide follower 20 the tensioning strap 32 passes downwardly around a fixed lower pulley 34 and then around a fixed upper pulley 36. The tensioning strap 32 continues around a counterweight pulley 38 and then is guided by a guide pulley 42 to the reel 28. A counterweight 40 is mounted to hang from the counterweight pulley 38.

Figure 2:
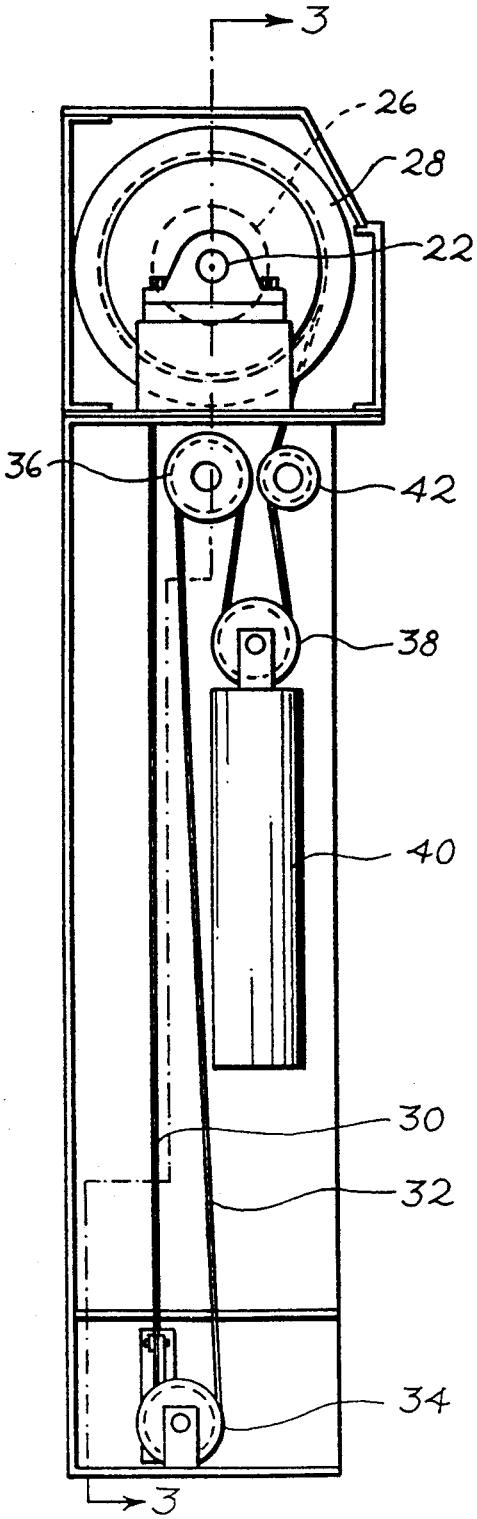
FIG. 2 is a cross-sectional view taken along line 2—2 of FIG. 1.

As shown in FIG. 2, the tensioning strap 32 is wound on the reel 28 in the opposite sense as the door 14 and the raising strap 30 are wound on the roller 26. This arrangement provides a simple and effective means for tensioning the door 14, and is described in greater detail in Manns U.S. Pat. No. 3,878,879, which is hereby incorporated by reference for its further explanation of the manner in which the door 14 is tensioned.

Figure 6:
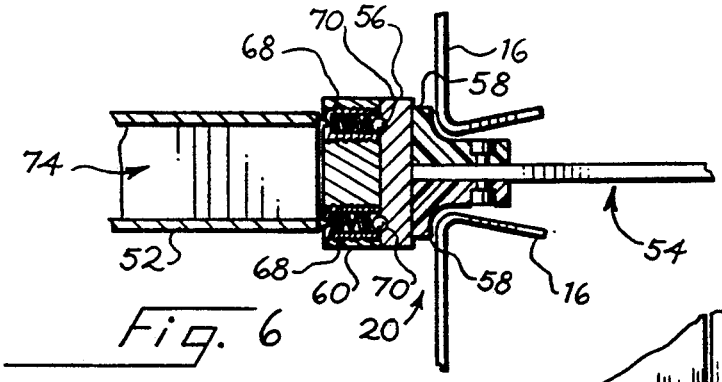
FIG. 6 is a cross-sectional view taken along line 6—6 of FIG. 5.

As best shown in FIGS. 5–7, each of the guide followers 20 includes a breakaway mechanism 50 secured adjacent a respective end of the lower rigid bar 52 of the door 14. Each breakaway mechanism 50 is identical, and for convenience only one of the two will be described below. Each breakaway mechanism 50 includes a first part 54 which receives the ends of the respective raising strap 30 and tensioning strap 32. This first part 54 serves to support a guide 58 that cooperates with the guide 16 to control vertical movement of the door 14. The first part 54 also supports a mounting element 56 which is rigidly secured to one end of the first part 54. A latch plate 60, which functions as a first retaining element in this embodiment, is mounted for rotation on the mounting element 56 by a post 62. In this embodiment the post 62 is a stud which is welded in place to the mounting element 56. The post 62 passes through an opening in the latch plate 60, and the post 62 thereby defines a pivot axis for the latch plate 60. A bronze sleeve 61 is interposed between the latch plate 60 and the post 62.

As best shown in FIG. 7, the latch plate 60 defines a slot 66 which extends from a central portion of the latch 60 to a perimeter portion 72. Thus, the slot 66 extends completely out of one side of the latch plate 60.

As best shown in FIGS. 6 and 7, the first part 54 also includes means for releasably holding the latch plate 60 in a desired position against forces tending to rotate the latch plate 60. In this embodiment this holding means includes two detent mechanisms 68 in the latch plate 60 which cooperate with respective recesses 70 in the mounting element 56. When the latch plate 60 is oriented as shown in FIGS. 5 and 6, the detent mechanisms 68 engage the recesses 70 and retain the latch plate in position. The detent mechanisms 68 include spring loaded balls, and the spring force is selected such that the detent mechanisms 68 hold the latch plate 60 in position against forces below a threshold value tending to rotate it. However, in the event such forces tending to rotate the latch plate 60 exceed the threshold value, the detent mechanisms 68 are compressed and rotation of the latch plate 60 is allowed to rotate. Preferably, the detent mechanisms 68 are threaded in the latch plate 60 to allow easy adjustment.

As best shown in FIGS. 5–7, the breakaway mechanism 50 also includes a second part 74 which in this embodiment is rigidly secured to the lower bar 52 of the door 14. This second part 74 includes a horizontally oriented steel pin 76 which in this embodiment operates as a second retaining element. The pin 76 is dimensioned to fit into the slot 66 as described in greater detail below. The second part 74 additionally defines a overhanging portion 78 which is shaped to fit around the upper portion of the latch plate 60. The overhanging portion 78 defines a recess 80 that receives the latch plate 60. This recess 80 is shaped to allow the latch plate 60 to pivot about the axis defined by the post 62 and to allow movement of the second part 74 relative to the first part 54 transverse to the plane of FIG. 5. The overhanging portion 78 cooperates with the pin 76 to insure that vertical forces applied to the first part 54 by the straps 30, 32 are applied to the second part 74 and thereby to the door 14. The overhanging portion 78 may be formed of brass to bear against the reverse side of the latch plate 60.

Figures 8, 9, 10, 11:
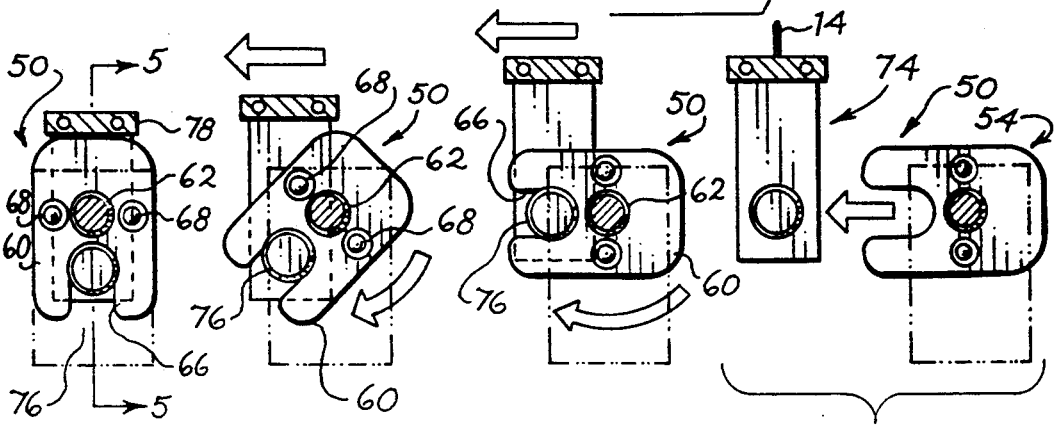
FIGS. 8–11 are consecutive sectional views taken along line 8–11—8–11 of FIG. 5 showing the breakaway mechanism at various stages during the breakaway process.

Turning now to FIGS. 8–11, the operation of the breakaway mechanism 50 can now be described. FIG. 8 shows a cross-sectional view of the breakaway mechanism 50 with the latch plate 60 positioned in a retaining position. Note that the pin 76 is captured in the slot 66, and the overhanging portion 78 cooperates with the pin 76 to prevent relative movement between the pin 76 and the latch plate 60. In this position, the detent mechanisms 68 are positioned in the recesses, and the breakaway mechanism 50 is stable until an excessive force (above a preset threshold) is applied to the door in a direction tending to rotate the latch plate 60.

FIG. 9 shows an intermediate stage in the release of the breakaway mechanism 50, after forces on the door directed to the left as shown in FIG. 9 have exceeded the threshold needed to release the detent mechanisms 68 from the recesses 70. Note that the latch plate 60 has begun to rotate about the pivot axis defined by the post 62.

FIG. 10 shows the breakaway mechanism 50 after the latch plate 60 has rotated to the release position, in which the axis of the slot 66 is substantially horizontal. Once in the release position, the latch plate 60 no longer restricts lateral movement of the door 14 in the direction of the applied force. Thus, the second part 74 and the attached door 14 are free to move laterally away from the first part 54 of the breakaway mechanism 50, as shown in FIG. 11.

Though FIGS. 8–11 show the latch plate 60 rotating in a clockwise direction to allow the door 14 to move to the left, it should be understood that the mechanism is symmetrical, and that if a force were applied to the door 14 from the left as shown in FIGS. 8–11, the latch plate 60 would rotate in a similar manner in a counter clockwise direction to release the pin 76.

The breakaway mechanism 50 can readily be reassembled after it is separated. Note that the pin 76 is allowed to rise as the latch plate 60 moves from the retaining position of FIG. 8 to the release position of FIG. 10. This reduces tension on the door 14, and makes it easier for the user to reposition the pin 76 in the slot 66 in order to reassemble the breakaway mechanism 50. Once this is done, the latch plate 60 can be rotated manually to return it to the retaining position of FIG. 8. This completes reassembly of the breakaway mechanism 50. Typically, there is no need even to open the door panel 18, and no parts or tools are required.

It should be apparent from the foregoing description that the first part 54 of the breakaway mechanism 50 extends into the opening 12 of the doorway 10 by a small amount. This reduces the likelihood that the first part 54 of the breakaway mechanism 50 will be damaged in an impact. As pointed out above, the detent mechanism 68 is easy to adjust, and it provides a precisely repeatable release action, because of the rotational movement of the latch plate 60 with respect to the mounting element 56. The arrangement of the raising strap 30 and the tensioning strap 32 described above provides the further advantage that the entire mechanism maintains its orientation even after the breakaway mechanism 50 has released the door 14 from the first part 54. This facilitates rapid reassembly by an operator without extensive training.

Of course, it should be understood that a wide range of changes and modifications can be made to the preferred embodiment described above. For example, the foregoing description utilizes a detent mechanism as a means for releasably holding the latch plate in position. Those skilled in the art will recognize that the means for releasably holding the latch plate in position can be embodied in other forms, as for example, any of the approaches used in the above-identified U.S. Pat. No. 5,025,847. Breakaway straps held together by a hook and loop fastener such as that marketed under the trade name VELCRO, frangible plates, shear pins and the like can all be substituted if desired for the detent mechanism described above. However, the detent mechanism described above provides the advantage that it operates in a precisely repeatable manner and does not require the replacement of parts in order to reassemble the breakaway mechanism 50.

Furthermore, the latch plate 60 does not in all embodiments have to define a slot to receive a pin. Instead, other edge surfaces of a pivoting element can be used to retain the second retaining element, and not all embodiments of this invention will require bi-directional operation. Bi-directional embodiments of this invention can utilize two separate latch plates, each with an edge surface that cooperates with the second retaining element. Also, if a slot is used, it does not necessarily have to pass completely through the latch plate, but can instead be formed as a recess in the latch plate.

Moreover, the embodiment shown in FIGS. 1–11 is manually operated, and it relies on an operator to raise and lower the door 14 manually. This embodiment includes a band brake 80 which is biased to a braked position by a lever 82. This band brake 80 can be manually released when it is desired to raise and lower the door. In alternate embodiments a reversible motor may be coupled to the shaft 22 to allow remote operation of the door 14.

It is therefore intended that the foregoing detailed description be regarded as illustrative rather than limiting, and that it be understood that it is the following claims, including all equivalents, which are intended to define the scope of this invention.

I claim:

1. In an apparatus for controlling passage through an opening, said apparatus comprising a guide positioned alongside the opening and a movable barrier configured to selectively block the opening, the improvement comprising:

a guide follower attached to the barrier and coupled to the guide to control movement of the barrier, said guide follower comprising first and second parts, wherein one of the first and second parts is attached to the barrier and the other of said first and second parts is positioned adjacent the guide and is free of direct attachment to the barrier;

said first part comprising a mounting element and a first retainer element pivotably mounted to said mounting element, said first retainer element pivotable between a retaining position and a release position;

said second part comprising a second retainer element configured and positioned (1) to engage the first retainer element when the first retainer element is in the retaining position to hold the first and second parts together, and (2) to disengage from the first retainer element when the first retainer element is in the release position to allow the first and second parts to separate from one another and to allow the barrier and said one of the first and second parts to separate from said other of the first and second parts.

2. The invention of claim 1 further comprising:

means for releasably holding the first retainer element in the retaining position against forces in a first, lower range of values tending to move the barrier transverse to the guide while allowing the first retainer element to move from the retaining to the release position in response to the forces in a second, higher range of values tending to move the barrier transverse to the guide, thereby allowing the first and second parts to separate from one another in response to forces in the second range of values.

3. The invention of claim 2 wherein the releasably holding means comprises a detent mechanism acting between the first retainer element and the mounting element.

4. The invention of claim 3 wherein the first retainer element pivots with respect to the mounting element about a pivot axis defined by a post, and wherein the post is provided with means for adjusting the separation between the mounting element and the first retaining element along the post to alter operation of the detent mechanism and to allow the second range of values to be adjusted.

5. The invention of claim 2 wherein the pivot axis is oriented substantially transverse to the guide.

6. The invention of claim 1 wherein the first retainer element defines a slot that extends to a perimeter portion of the first retainer element, and wherein the slot is shaped to receive a portion of the second retainer element.

7. The invention of claim 6 wherein the slot is positioned vertically with the perimeter portion of the first retainer element adjacent the slot positioned downwardly when the first retainer element is in the retaining position, and wherein the slot is positioned horizontally when the first retainer element is in the release position.

8. The invention of claim 7 wherein the first retainer element is pivotable in both directions from the retaining position.

9. The invention of claim 6 wherein said first part comprises a post that defines a pivot axis for said first retainer element, and wherein said post is positioned above the end portion of the second retainer element when the end portion is received in the slot and the first retainer element is in the retaining position.

10. The invention of claim 1 wherein the second retainer element defines a recess shaped to receive a portion of the first retainer element, wherein said recess is shaped (1) to allow the first retainer element to pivot from the retaining position to the release position in a pivoting plane, and (2) to prevent the first retainer element from moving transverse to the pivoting plane with respect to the second retainer element while the first retainer element is disposed in the recess.

11. The invention of claim 1 wherein the movable barrier comprises a roll door.

12. The invention of claim 1 further comprising:

a releasable holding element coupled to the first retainer element to resist pivoting movement of the first retainer element from the retaining to the release positions.

13. The invention of claim 1 wherein the first retainer element pivots with respect to the mounting element about a pivot axis, and wherein the pivot axis is oriented substantially transverse to the guide.

14. In an apparatus for controlling passage through a doorway, said apparatus comprising a guide positioned alongside the doorway and a roll door mounted to block the doorway selectively, the improvement comprising:

a guide follower attached to the door to travel along the guide to control movement of the door, said guide follower comprising first and second parts, wherein one of the first and second parts is attached to the door, and the other of the first and second parts is positioned adjacent the guide;

said first part comprising a mounting element and a first retainer element mounted to the mounting element to pivot about a pivot axis between a retaining position and a release position;

said second part comprising a second retainer element configured and positioned (1) to engage the first retainer element when the first retainer element is in the retaining position to hold the first and second parts together, and (2) to disengage from the first retainer element by moving transversely to the guide when the first retainer element is in the release position to allow the first and second parts to separate from one another; and a releasable holding element coupled to the first retainer element to resist pivoting movement of the first retainer element to the release position, said releasable holding element allowing the first retainer element to pivot to the release position in response to forces on the door.

15. The invention of claim 14 wherein the releasable holding element comprises a detent mechanism acting between the first retainer element and the mounting element.

16. The invention of claim 14 wherein the first retainer element defines a slot that extends to a perimeter portion of the first retainer element, and wherein the slot is shaped to receive the second retainer element.

17. The invention of claim 14 wherein the first retainer element is pivotable in both directions from the retaining position.

18. In an apparatus for controlling passage through an opening, said apparatus comprising a guide positioned alongside the opening and a movable barrier configured to selectively block the opening, the improvement comprising:

a guide follower attached to the barrier and coupled to the guide to control movement of the barrier, said guide follower comprising first and second parts, wherein one of the first and second parts is attached to the barrier and the other of said first and second parts is positioned adjacent the guide;

said first part comprising a mounting element and a first retainer element pivotably mounted to said mounting element, said first retainer element pivotable between a retaining position and a release position;

said second part comprising a second retainer element configured and positioned (1) to engage the first retainer element when the first retainer element is in the retaining position to hold the first and second parts together, and (2) to disengage from the first retainer element when the first retainer element is in the release position to allow the first and second parts to separate from one another;

wherein the first retainer element defines a slot that extends to a perimeter portion of the first retainer element, and wherein the slot is shaped to receive a portion of the second retainer element.

19. The invention of claim 18 wherein the slot is positioned vertically with the perimeter portion of the first retainer element adjacent the slot positioned downwardly when the first retainer element is in the retaining position, and wherein the slot is positioned horizontally when the first retainer element is in the release position.

20. The invention of claim 19 wherein the first retainer element is pivotable in both directions from the retaining position.

21. The invention of claim 18 wherein said first part comprises a post that defines a pivot axis for said first retainer element, and wherein said post is positioned above the end portion of the second retainer element when the end portion is received in the slot and the first retainer element is in the retaining position.

22. In an apparatus for controlling passage through a doorway, said apparatus comprising a guide positioned alongside the doorway and a roll door mounted to block the doorway selectively, the improvement comprising:

a guide follower attached to the door to travel along the guide to control movement of the door, said guide follower comprising first and second parts, wherein one of the first and second parts is attached to the door, and the other of the first and second parts is positioned adjacent the guide;

said first part comprising a mounting element and a first retainer element mounted to the mounting element to pivot about a pivot axis between a retaining position and a release position;

said second part comprising a second retainer element configured and positioned (1) to engage the first retainer element when the first retainer element is in the retaining position to hold the first and second parts together, and (2) to disengage from the first retainer element when the first retainer element is in the release position to allow the first and second parts to separate from one another; and a releasable holding element coupled to the first retainer element to resist pivoting movement of the first retainer element to the release position, said releasable holding element allowing the first retainer element to pivot to the release position in response to forces on the door;

wherein the first retainer element defines a slot that extends to a perimeter portion of the first retainer element, and wherein the slot is shaped to receive the second retainer element.

* * * * *